United States Patent [19]

Zakharov et al.

[11] 4,049,474

[45] Sept. 20, 1977

[54] ALUMINUM-BASED ALLOY

[76] Inventors: Evegny Dmitrievich Zakharov, Elokhovsky proezd, 5/50, kv. 4a, Moscow; Gennady Lvovich Shneider, ulitsa Marshala Birjuzova, 28, kv. 145, Odintsovo Moskovskoi oblasti; Viktor Dmitrievich Valkov, ulitsa Srednyaya Pervomaiskaya, 19, kv. 145, Moscow; Viktor Pavlovich Kapitonov, ulitsa Marshala Birjuzova, 40, kv. 90, Moscow; Petr Grigorievich Miklyaev, Bobruiskaya ulitsa, 18, korpus 1, kv. 50, Moscow; Vladimir Alexandrovich Lebedev, ulitsa Gamaleya, 2, kv. 41, Moscow; Vera Ivanovna Kholnova, ulitsa Gorkogo, 40, kv. 13, Moscow; Stanislav Alexeevich Shesterikov, Frunzenskaya naberezhnaya, 26, kv. 55, Moscow; Vasily Mikhailovich Bobrovsky, ulitsa Nedelina, 8, kv. 49, Moscow, all of U.S.S.R.

[21] Appl. No.: 599,131

[22] Filed: July 25, 1975

[51] Int. Cl.[2] ..... C22C 21/10

[52] U.S. Cl. ..... 148/32.5; 75/141; 148/20.6; 148/159

[58] Field of Search ..... 75/141, 146; 148/32, 148/32.5, 159, 20.6

[56] References Cited

U.S. PATENT DOCUMENTS 2,245,167 Stroup ..... 75/141

*Primary Examiner*—R. Dean

*Attorney, Agent, or Firm*—Lackenbach, Lilling & Siegel

[57] ABSTRACT

An aluminum-based alloy containing, wt %:

zinc 6.5–7.6 magnesium 1.6–2.2.

copper 0.8–1.2 cobalt 0.05–0.2.

zirconium 0.05–0.3 with admixtures of iron up to 0.3 wt %, silicon up to 0.3 wt %, chromium up to 0.05 wt %, manganese up to 0.05 wt %, the balance being aluminum.

The alloy may most effectively be used for manufacturing bulky parts of loaded units.

2 Claims, No Drawings

ALUMINUM-BASED ALLOY

The present invention relates to non-ferrous metallurgy, and more particularly to aluminum-based alloys featuring increased strength and plasticity and intended for manufacturing bulky parts of loaded units.

In metallurgy, there is known an alloy containing, wt. %:

zinc 5 - 7
magnesium 1.8 - 3
copper 1.4 - 2
manganese 0.2 - 0.6
chromium 0.1 - 0.25 with admixtures of silicon up to 0.5 wt %, iron up to 0.5 wt %, the balance being aluminum.

This alloy exhibits good mechanical properties and high static strength.

However, its hardenability is low which restricts its field of usage in manufacturing semiproducts more than 120 mm thick. Besides, improvement of mechanical properties of parts made from this alloy involves quenching which brings about high internal hardening stresses eventually resulting in warpage of these parts in subsequent machining.

Disclosed in USSR Inventor's Certificate No. 155,001 is an alloy containing, wt %:

zinc 8.2 - 9.0
magnesium 2.4 - 3.0
copper 2.0 - 2.6
zirconium 0.1 - 0.2
manganese 0.2 - 0.8 with admixtures of chromium up to 0.1 wt %, iron up to 0.4 wt %, silicon up to 0.3 wt %, beryllium up to 0.002 wt %, the balance being aluminum.

This alloy is characterized by increased strength.

However, its hardenability is low, as well as its plasticity and static strength in short transverse direction of a semiproduct made therefrom. That is why its usage is limited to making thin-walled blanks cooled in the process of solution treatment in cold water.

The most extensively used alloy at present is the one described in USSR Inventor's Certificate No. 128,614 containing, wt %:

zinc 5.0 - 7.0
magnesium 1.7 - 3.6
copper 0.8 - 2.0
iron 0.2 - 0.4 with admixtures of silicon up to 0.2 wt %, manganese up to 0.1 wt %, titanium up to 0.1 wt %, the balance being aluminum.

This alloy's hardenability is satisfactory when it is cooled in water at a temperature of 75° - 85° C.

However, the plasticity of the alloy decreases when it is hardened in boiling water. Yet, hardening in water heated to 75°-85° C involves higher hardening stresses as compared to hardening in boiling water.

The principal object of this invention is to provide an aluminum-based alloy possessing high hardenability.

Another object of the invention is to provide an aluminum-based alloy of high strength and plasticity in short transverse direction of bulky products made therefrom, after solution treatment with cooling, harden in boiling water.

Still another object of the invention is to provide an aluminum-based alloy featuring high static endurance and corrosion resistance.

These and other objects are achieved in an aluminum-based alloy containing zinc, magnesium, copper and such admixtures as iron, silicon, chromium and manganese, which according to the invention, in addition to the basic components taken in the following amounts, wt %:

zinc 6.5 - 7.6
magnesium 1.6 - 2.2
copper 0.8 - 1.2, contains 0.05 - 0.2 wt % cobalt and 0.05 - 0.3 wt % zirconium as well as the following admixtures: 0.3 wt % iron, 0.3 wt % silicon, 0.05 wt % chromium, 0.05 wt % manganese, the balance being aluminum.

Lower content of zinc and magnesium in the aluminum-based alloy results in lesser strength thereof, whereas higher content of zinc and magnesium in the alloy deteriorates the hardenability of semiproducts made from this alloy.

A decrease in the copper content makes the alloy less corrosion-resistant, whereas its excess results in loss of static endurance of the alloy.

The zirconium component adds to the strength of the alloy.

Cobalt addition improves plasticity and static endurance of the alloy as well as its hardenability.

The best combination of mechanical properties, hardenability and corrosion resistance is achieved in alloys where the zinc to magnesium ratio constitutes substantially 2.9 to 4.7.

EXAMPLE 1

Placed in a furnace is a charge including aluminum, aluminum alloys with cobalt and zirconium, as well as aluminum alloy scrap after the charge has melted. Copper, zinc and magnesium are added in rated quantities. The melt is then refined and poured into a holding furnace to be further refined there and cast into ingots.

The obtained aluminum-based alloy contains the following components, wt.%:

zinc 6.5
magnesium 1.6
copper 0.8
cobalt 0.05
zirconium 0.05 with the following admixtures: iron up to 0.2 wt %, silicon up to 0.09 wt %, chromium up to 0.05 wt %, manganese up to 0.01 wt %, the balance being aluminum.

The alloy features good hardenability and plasticity.

The above-described alloy can be used to best advantage in manufacturing bulky and intricately shaped forgings and die-forgings with minimum internal stresses and good mechanical properties, high durability and reliability in operation.

EXAMPLE 2

Obtained by the procedure of Example 1 is an alloy of the following composition, wt %:

zinc 7.18
magnesium 1.87
copper 0.93
cobalt 0.11
zirconium 0.15 with the following admixtures: iron up to 0.22 wt %, silicon up to 0.1 wt %, chromium up to 0.05 wt %, manganese up to 0.02, wt %, the balance being aluminum.

This alloy is characterized by high strength, plasticity and hardenability.

It can be most effectively made use of in manufacturing precision loaded parts and critical units operating under variable loads.

Various rotor impellers, as well as rotors of compound-mixing and analytical ultra centrifuges made by swaging blanks of this alloy fall into this category.

Compound-mixing ultracentrifuge rotors made from this alloy perform in contact with alkaline and acid solutions at rotating speeds favorably comparable with those of titanium-alloy rotors.

EXAMPLE 3

The procedure described in Example 1 is employed to obtain an alloy of the following composition, wt %;

zinc 7.6
magnesium 2.2
copper 1.2
cobalt 0.2
zirconium 0.3 with the following admixtures: iron up to 0.3 wt %, silicon up to 0.3 wt %, chromium up to 0.05 wt %, manganese up to 0.05 wt %, the balance being aluminum.

This alloy is extremely strong and may most effectively be used to manufacture blanks by swaging. In this case, a marked increase in longitudinal strength can be achieved.

What is claimed is:

1. A bulky aluminum-based alloy product having high strength and plasticity in short transverse direction and relatively low internal stress, the alloy consisting essentially of, measured as weight percent:

zinc: 6.5 – 7.6;
magnesium: 1.6 – 2.2;
copper: 0.8 – 1.2;
cobalt: 0.05 – 0.2;
zirconium: 0.05 – 0.3; and the balance comprising aluminum and up to 0.3 weight percent iron, up to 0.3 weight percent silicon, up to 0.05 weight percent chromium, and up to 0.05 weight percent manganese, the bulky product having been subjected to solution treatment with cooling and hardening in boiling water.

2. The aluminum product in accordance with claim 1, wherein the weight ratio of zinc-to-magnesium in the aluminum-based alloy is in the range of substantially 2.9 to 4.7.

* * * * *